US010982413B2

(12) United States Patent
Fukuda et al.

(10) Patent No.: US 10,982,413 B2
(45) Date of Patent: Apr. 20, 2021

(54) HYDRAULIC SYSTEM FOR WORKING MACHINE

(71) Applicant: KUBOTA CORPORATION, Osaka (JP)

(72) Inventors: Yuji Fukuda, Osaka (JP); Yoshimitsu Tanaka, Osaka (JP); Keigo Honda, Osaka (JP)

(73) Assignee: Kubota Corporation, Osaka (JP)

( * ) Notice: Subject to any disclaimer, the term of this patent is extended or adjusted under 35 U.S.C. 154(b) by 0 days.

(21) Appl. No.: 16/364,637

(22) Filed: Mar. 26, 2019

(65) Prior Publication Data

US 2019/0301141 A1 Oct. 3, 2019

(30) Foreign Application Priority Data

Mar. 28, 2018 (JP) ..... 2018-062417

(51) Int. Cl.
*E02F 9/22* (2006.01)

(52) U.S. Cl.
CPC ..... *E02F 9/2225* (2013.01); *E02F 9/2285* (2013.01); *F15B 2211/20515* (2013.01); *F15B 2211/30525* (2013.01)

(58) Field of Classification Search
CPC .... F15B 2211/30525; F15B 2211/3105; F15B 2211/3122; F15B 2211/3133; F15B 2211/31511; E02F 9/2285; E02F 9/2225; E02F 9/2239; E02F 9/2292; E02F 3/3414
See application file for complete search history.

(56) References Cited

U.S. PATENT DOCUMENTS 9,410,560 B2 * 8/2016 Coombs ..... F15B 11/16
2013/0098013 A1 * 4/2013 Edler ..... F15B 11/17 60/327

FOREIGN PATENT DOCUMENTS

JP 2010270527 12/2010

* cited by examiner

*Primary Examiner* — Abiy Teka
(74) *Attorney, Agent, or Firm* — Greenblum & Bernstein, P.L.C.

(57) ABSTRACT

A hydraulic system includes a hydraulic pump, a first hydraulic actuator, a second hydraulic actuator, a first control valve to control the first hydraulic actuator, and a second control valve to control the second hydraulic actuator, the second control valve being arranged on a downstream side of the first control valve. The hydraulic system includes a discharge fluid tube in which the operation fluid flows. The discharge fluid tube is connected to the first control valve. The hydraulic system includes a first fluid tube in which a return fluid flows toward the second control valve. The first fluid tube couples the first control valve to the second control valve. The hydraulic system includes a second fluid tube in which the return fluid flows toward the discharge fluid tube, and a third fluid tube in which a supply fluid flows toward the first fluid tube.

18 Claims, 6 Drawing Sheets

HYDRAULIC SYSTEM FOR WORKING MACHINE

CROSS-REFERENCE TO RELATED APPLICATIONS

The present application claims priority under 35 U.S.C. § 119 to Japanese Patent Application No. 2018-062417, filed Mar. 28, 2018. The content of this application is incorporated herein by reference in their entirety.

BACKGROUND OF THE INVENTION

Field of the Invention

The present invention relates to a hydraulic system for a working machine and to a control valve.

Description of Related Art

A hydraulic system for a working machine disclosed in Japanese Patent Application Publication No. 2010-270527 is conventionally known. The working machine disclosed in Japanese Patent Application Publication No. 2010-270527 includes a boom, a bucket, a boom cylinder to move the boom, a bucket cylinder to move the bucket, an auxiliary actuator to actuate an auxiliary attachment, a first control valve to control stretching and shortening of the boom cylinder, a second control valve to control stretching and shortening of the bucket cylinder, and a third control valve to actuate the auxiliary actuator.

SUMMARY OF THE INVENTION

A hydraulic system for a working machine includes a hydraulic pump to output an operation fluid, a first hydraulic actuator, a second hydraulic actuator, a first control valve to control the first hydraulic actuator, and a second control valve to control the second hydraulic actuator, the second control valve being arranged on a downstream side of the first control valve. The hydraulic system for the working machine further includes a discharge fluid tube in which the operation fluid having passed through the first control valve flows. The discharge fluid tube is connected to the first control valve. The hydraulic system for the working machine further includes a first fluid tube in which a return fluid that is the operation fluid returning from the first hydraulic actuator to the first control valve flows toward the second control valve. The first fluid tube couples the first control valve to the second control valve. The hydraulic system for the working machine further includes a second fluid tube in which the return fluid flows toward the discharge fluid tube, and a third fluid tube in which a supply fluid that is the operation fluid other than the return fluid flows toward the first fluid tube, the supply fluid having been supplied from the hydraulic pump to the first control valve.

A hydraulic system for a working machine, includes a hydraulic pump to output an operation fluid, a first hydraulic actuator, a second hydraulic actuator, a first control valve to control the first hydraulic actuator, and a second control valve to control the second hydraulic actuator, the second control valve being arranged on a downstream side of the first control valve. The first control valve has a first operational position and a second operational position and is switched between the first operational position and the second operational position. The first operational position allows a return fluid to be supplied to the second control valve, the return fluid returning from the first hydraulic actuator to the first control valve. The second operational position allows the return fluid to be discharged to a discharge fluid tube through the first control valve, and allows a supply fluid to be supplied to the second control valve, the supply fluid being supplied from the hydraulic pump to the first control valve separately from the return fluid.

DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
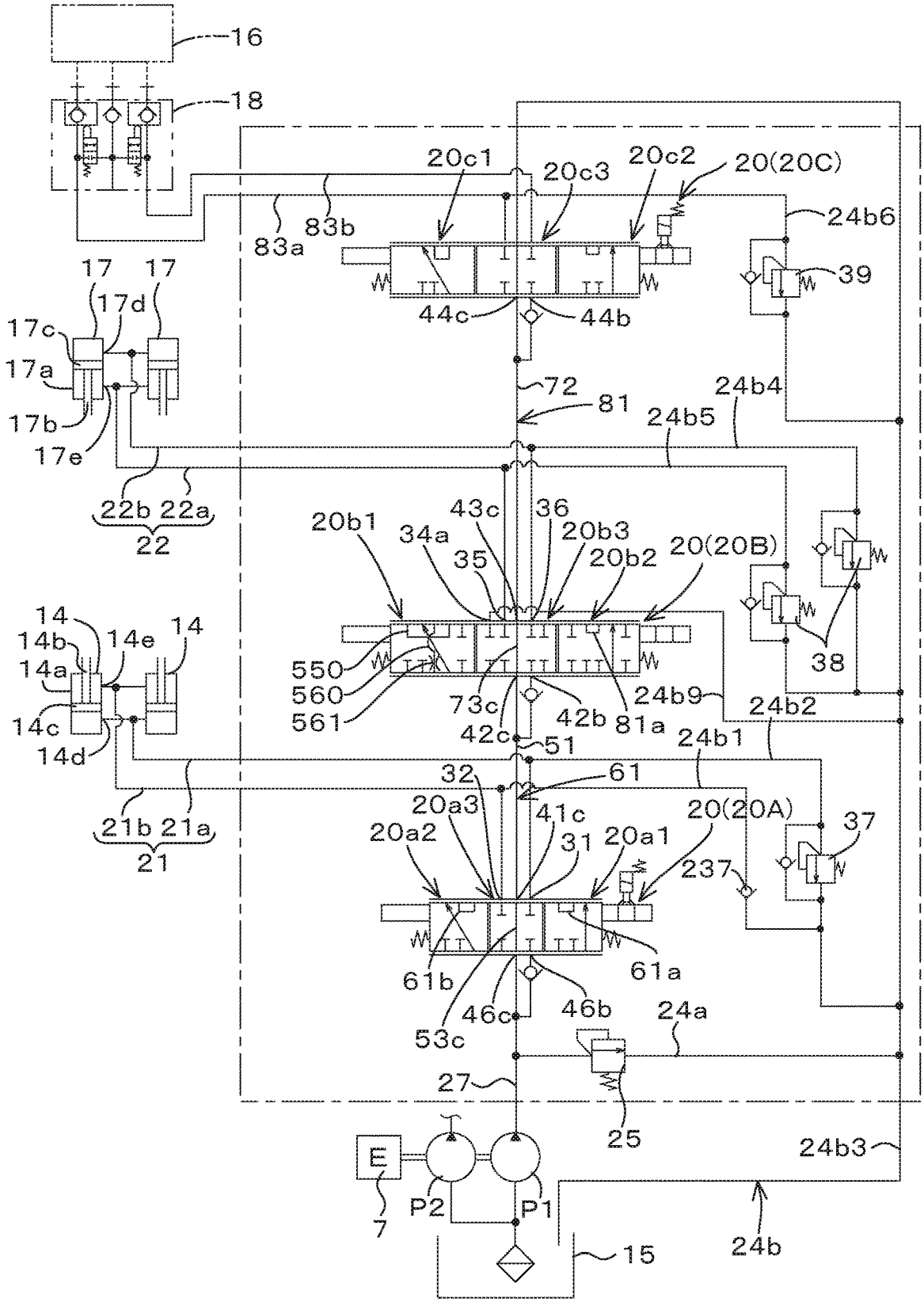
FIG. 1 is a view illustrating a hydraulic system (hydraulic circuit) for a working machine according to an embodiment of the present invention.

The embodiments will now be described with reference to the accompanying drawings, wherein like reference numerals designate corresponding or identical elements throughout the various drawings. The drawings are to be viewed in an orientation in which the reference numerals are viewed correctly.

Hereinafter, an embodiment of the present invention will be described below with reference to the drawings as appropriate.

Specifically, embodiments of a hydraulic system for a working machine according to the present invention and of the working machine having the hydraulic system will be described below with reference to the drawings as appropriate.

Figure 5:
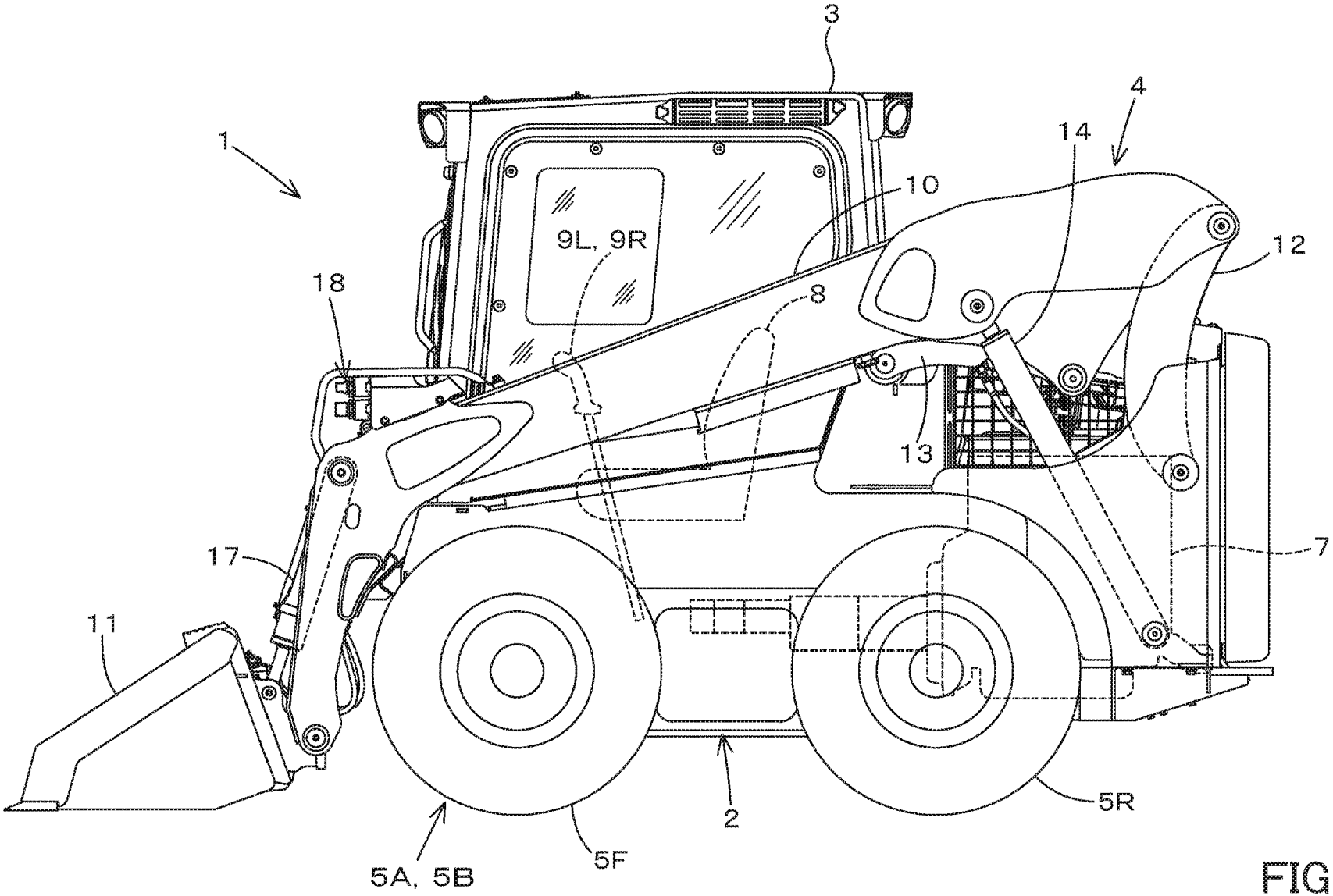
FIG. 5 is a whole view of a skid steer loader exemplified as the working machine according to the embodiment.

Firstly, the working machine will be explained. FIG. 5 shows a side view of the working machine according to the present invention. In FIG. 5, a skid steer loader is shown as an example of the working machine.

However, the working machine according to the present invention is not limited to the skid steer loader. For example, the working machine may be another type of loader working machine such as a compact track loader. In addition, the working machine may be another working machine other than the loader working machine.

The working machine 1 includes a machine body (vehicle body) 2, a cabin 3, a working device 4, and traveling devices 5A and 5B.

A cabin 3 is mounted on the machine body 2. An operator seat 8 is provided at a rear portion of an inside of the cabin 3. In the embodiment of the present invention, the front side of the operator seated on the operator seat 8 of the working machine 1 (the left side in FIG. 5) is referred to as the front. The rear side of the operator (the right side in FIG. 5) is referred to as the rear. The left side of the operator (a front surface side of FIG. 5) is referred to as the left. The right side of the operator (a back surface side of FIG. 5) is referred to as the right.

In addition, a horizontal direction which is a direction orthogonal to the front-to-rear direction will be referred to as a machine width direction. And, a direction from the center portion of the machine body 2 to the right portion or the left portion will be referred to as a machine outward direction. In other words, the machine outward direction is the machine width direction separating from the machine body 2.

In the explanation, a direction opposite to the machine outward direction is referred to as a machine inward direction. In other words, the machine inward direction is the machine width direction approaching the machine body 2.

The cabin 3 is mounted on the machine body 2. The working device 4 is an apparatus that performs the work and is mounted on the machine body 2. The traveling device 5A is a device for the traveling of the machine body 2, and is provided on the left side of the machine body 2. The traveling device 5B is a device for the traveling of the machine body 2, and is provided on the right side of the machine body 2.

A prime mover 7 is provided at the rear portion of the inside of the machine body 2. The prime mover 7 is an engine (diesel engine). It should be noted that the prime mover 7 is not limited to the engine, and may be an electric motor or the like.

A traveling lever 9L is provided on the left side of the operator seat 8. A traveling lever 9R is provided on the right side of the operator seat 8. The traveling lever 9L provided on the left is for operating the travel device 5A provided on the left, and the traveling lever 9R provided on the right is for operating the travel device 5B provided on the right.

The working device 4 includes a boom 10, a bucket 11, a lift link 12, a control link 13, a boom cylinder 14, and a bucket cylinder 17. The boom 10 is provided on the side of the machine body 2.

The bucket 11 is provided at the tip end (front end) of the boom 10. The lift link 12 and the control link 13 support the base portion (rear portion) of the boom 10. The boom cylinder 14 moves the boom 10 upward and downward.

In particular, the lift link 12, the control link 13 and the boom cylinder 14 are provided on the side of the machine body 2. An upper portion of the lift link 12 is pivotally supported on an upper portion of the base portion of the boom 10. A lower portion of the lift link 12 is pivotally supported on the side portion of the rear portion of the machine body 2.

The control link 13 is arranged in front of the lift link 12. One end of the control link 13 is pivotally supported at a lower portion of a base portion of the boom 10, and the other end is pivotally supported by the machine body 2.

The boom cylinder 14 is a hydraulic cylinder configured to move the boom 10 upward and downward. The upper portion of the boom cylinder 14 is pivotally supported on the front portion of the base portion of the boom 10. The lower portion of the boom cylinder 14 is pivotally supported on the side portion of the rear portion of the machine body 2. When the boom cylinder 14 is stretched and shortened, the lift link 12 and the control link 13 swing the boom 10 upward and downward.

The bucket cylinder 17 is a hydraulic cylinder configured to swing the bucket 11. The bucket cylinder 17 couples between the left portion of the bucket 11 and the boom provided on the left, and couples between the right portion of the bucket 11 and the boom provided on the right.

In addition, in place of the bucket 11, an auxiliary attachment such as a hydraulic crusher, a hydraulic breaker, an angle broom, an auger, a pallet fork, a sweeper, a mower, a snow blower or the like can be attached to the tip end (front portion) of the boom 10.

In the present embodiment, wheel-type traveling devices 5A and 5B each having the front wheels 5F and the rear wheels 5R are adopted as the traveling devices 5A and 5B. Meanwhile, crawler type traveling devices 5A and 5B (including semi-crawler type traveling devices 5A and 5B) may be adopted as the traveling devices 5A and 5B.

Next, a working hydraulic circuit (working hydraulic system) provided in the skid steer loader 1 will be described below.

The working hydraulic system is a system configured to operate the boom 10, the bucket 11, the auxiliary attachment and the like. As shown in FIG. 1, the working hydraulic system includes a plurality of control valves 20 and a working hydraulic pump (first hydraulic pump) P1. In addition, the working hydraulic system is provided with a second hydraulic pump P2 other than the first hydraulic pump P1.

The first hydraulic pump P1 is a pump configured to be operated by the power of the prime mover 7. The first hydraulic pump P1 is constituted of a constant displacement type gear pump. The first hydraulic pump P1 is configured to output the operation fluid stored in a tank (operation fluid tank) 15.

The second hydraulic pump P2 is a pump configured to be operated by the power of the prime mover 7. The second hydraulic pump P2 is constituted of a constant displacement type gear pump. The second hydraulic pump P2 is configured to output the operation fluid stored in the tank (operation fluid tank) 15.

In the hydraulic system, the second hydraulic pump P2 outputs the operation fluid for signals and the operation fluid for controls. The operation fluid for signals and the operation fluid for controls are referred to as a pilot fluid.

The plurality of control valves 20 are valves configured to control various types of hydraulic actuators provided in the working machine 1. The hydraulic actuator is a device configured to be operated by the operation fluid, and is constituted of a hydraulic cylinder, a hydraulic motor, or the like. In the embodiment, the plurality of control valves 20 include a boom control valve 20A, a bucket control valve 20B, and an auxiliary control valve 20C.

The boom control valve 20A is a valve configured to control the hydraulic actuator (boom cylinder) 14 that moves the boom 10. The boom control valve 20A is constituted of a direct-acting spool type three-position switching valve (a direct-acting spool type three-position selector valve).

The boom control valve 20A is configured to be switched to a neutral position 20*a*3, to a first position 20*a*1 other than the neutral position 20*a*3, and to a second position 20*a*2 other than the neutral position 20*a*3 and the first position 20*a*1.

In the boom control valve 20A, the switching between the neutral position 20*a*3, the first position 20*a*1, and the second position 20*a*2 is performed by moving the spool through operation of the operation member.

Meanwhile, the switching of the boom control valve 20A is performed by directly moving the spool through manual operation of the operation member. However, the spool may be moved by the hydraulic operation (hydraulic operation by a pilot valve, and hydraulic operation by a proportional valve).

In addition, the spool may be moved by the electric operation (electric operation by exciting the solenoid). In addition, the spool may be moved by other methods.

The boom control valve 20A and the first hydraulic pump P1 are coupled by an output fluid tube 27. A discharge fluid tube 24*a* connected to the operation fluid tank 15 is connected to a section between the boom control valve 20A and the first hydraulic pump P1.

A relief valve (main relief valve) 25 is provided to an intermediate portion of the discharge fluid tube 24*a*. The operation fluid outputted from the first hydraulic pump P1 passes through the output fluid tube 27 and is supplied to the boom control valve 20A. In addition, the boom control valve 20A and the boom cylinder 14 are coupled to each other by a fluid tube 21.

In particular, the boom cylinder 14 includes a cylindrical body 14*a*, a rod 14*b* movably provided on the cylindrical body 14*a*, and a piston 14*c* provided on the rod 14*b*.

A first port 14*d* for supplying and discharging the operation fluid is provided on the base end portion of the cylindrical body 14*a* (on the side opposite to the rod 14*b* side). A second port 14*e* for supplying and discharging the operation fluid is provided on the tip end of the cylindrical body 14*a* (on the side of the rod 14*b*).

The fluid tube 21 includes a communication fluid tube 21*a* and a communication fluid tube 21*b*. The communication fluid tube 21*a* couples the first port 31 of the boom control valve 20A to the first port 14*d* of the boom cylinder 14. The communication fluid tube 21*b* couples the second port 32 of the boom control valve 20A to the second port 14*e* of the boom cylinder 14.

Thus, when the boom control valve 20A is set to the first position 20*a*1 (a moving-up position), the operation fluid can be supplied from the communication fluid tube 21*a* to the first port 14*d* of the boom cylinder 14, and further the operation fluid can be discharged from the second port 14*e* of the boom cylinder 14 to the communication fluid tube 21*b*. In this manner, the boom cylinder 14 is stretched, and thereby the boom 10 moves upward.

When the boom control valve 20A is set to the second position 20*a*2 moving-down position), the operation fluid can be supplied from the communication fluid tube 21*b* to the second port 14*e* of the boom cylinder 14, and further the operation fluid can be discharged from the first port 14*d* of the boom cylinder 14 to the communication fluid tube 21*a*. In this manner, the boom cylinder 14 is shortened, and thereby the boom 10 moves downward.

The bucket control valve 20B is a valve configured to control the hydraulic cylinder (bucket cylinder) 17 that controls the movement of the bucket 11. The bucket control valve 20B is a three-position switching valve of pilot-actuated direct-acting spool type (a three-position selector valve of pilot-actuated direct-acting spool type).

The bucket control valve 20B is configured to be switched to a neutral position 20*b*3, to a first position 20*b*1 other than the neutral position 20*b*3, and to a second position 20*b*2 other than the neutral position 20*b*3 and the first position 20*b*1. In the bucket control valve 20B, the switching between the neutral position 20*b*3, the first position 20*b*1, and the second position 20*b*2 is performed by moving the spool through operation of the operation member.

Meanwhile, the switching of the bucket control valve 20B is performed by directly moving the spool through manual operation of the operation member. However, the spool may be moved by the hydraulic operation (hydraulic operation by a pilot valve, and hydraulic operation by a proportional valve). In addition, the spool may be moved by the electric operation (electric operation by exciting the solenoid). In addition, the spool may be moved by other methods.

The bucket control valve 20B and the bucket cylinder 17 are coupled by a fluid tube 22. More specifically, the bucket cylinder 17 includes a cylindrical body 17*a*, a rod 17*b* movably provided on the cylindrical body 17*a*, and a piston 17*c* provided on the rod 17*b*.

A first port 17*d* for supplying and discharging the operation fluid is provided on the base end portion (the side opposite to the rod 17*b* side) of the cylindrical body 17*a*. A second port 17*e* for supplying and discharging the operation fluid is provided on the tip end (the side of the rod 17*b*) of the cylindrical body 17*a*.

The fluid tube 22 includes a communication fluid tube 22*a* and a communication fluid tube 22*b*. The communication fluid tube 22*a* couples the first port 35 of the bucket control valve 20B to the second port 17*e* of the bucket cylinder 17. The communication fluid tube 22*b* couples the second port 36 of the bucket control valve 20B to the first port 17*d* of the bucket cylinder 17.

Thus, when the bucket control valve 20B is set to the first position (shoveling position) 20*b*1, the operation fluid can be supplied from the communication fluid tube 22*a* to the second port 17*e* of the bucket cylinder 17, and further the operation fluid can be discharged from the first port 17*d* of the bucket cylinder 17 to the communication fluid tube 22*b*.

In this manner, the bucket cylinder 17 is shortened, and thereby the bucket 11 performs the shoveling operation. When the bucket control valve 20B is set to the second position (dumping position) 20*b*2, the operation fluid can be supplied from the communication fluid tube 22*b* to the first port 17*d* of the bucket cylinder 17, and further the operation fluid can be discharged from the second port 170 of the bucket cylinder 17 to the communication fluid tube 22*a*. In this manner, the bucket cylinder 17 is stretched, and thereby the bucket 11 performs the dumping operation.

The auxiliary control valve 20C is a valve configured to control the hydraulic actuator (hydraulic cylinder, hydraulic motor, and the like) 16 attached to the auxiliary attachment. The auxiliary control valve 20C is a three-position switching valve of pilot-actuated direct-acting spool type (a three-position selector valve of pilot-actuated direct-acting spool type).

The auxiliary control valve 20C is configured to be switched to a neutral position 20*c*3, to a first position 20*c*1 other than the neutral position 20*c*3, and to a second position 20*c*2 other than the neutral position 20*c*3 and the first position 20*c*1. In the auxiliary control valve 20C, the switching between the neutral position 20*c*3, the first position 20*c*1, and the second position 20*c*2 is performed by moving the spool with use of a pressure of the pilot fluid.

A coupling member 18 is connected to the auxiliary control valve 20C via supplying-discharging fluid tubes 83*a* and 83*b*. A fluid tube connected to the hydraulic actuator 16 of the auxiliary attachment is connected to the coupling member 18.

Thus, when the auxiliary control valve 20C is set to the first position 20*c*1, the operation fluid can be supplied from the supplying-discharging fluid tube 83*a* to the hydraulic actuator 16 of the auxiliary attachment. When the auxiliary control valve 20C is set to the second position 20*c*2, the operation fluid can be supplied from the supplying-discharging fluid tube 83*b* to the hydraulic actuator 16 of the auxiliary attachment.

In this manner, when the operation fluid is supplied to the hydraulic actuator 16 from the supplying-discharging fluid tube 83*a* or the supplying-discharging fluid tube 83*b*, the hydraulic actuator 16 (the auxiliary attachment) can be operated.

The series circuit s fluid tube) is employed in the hydraulic system. In the series circuit, the operation fluid returned from the hydraulic actuator to the control valve arranged on the upstream side can be supplied to the control valve arranged on the downstream side.

For example, focusing on the bucket control valve 20B and the auxiliary control valve 20C, the bucket control valve 20B is the control valve arranged on the upstream side, and the auxiliary control valve 20C is the control valve arranged on the downstream side.

Hereinafter, the control valve arranged on the upstream side is referred to as a "first control valve", and the control valve arranged on the downstream side is referred to as a "second control valve". A control valve other than the first control valve and the second control valve and provided on the upstream side upper from the second control valve is referred to as a "third control valve".

In addition, the hydraulic actuator corresponding to the first control valve is referred to as a "first hydraulic actuator". The hydraulic actuator corresponding to the second control valve is referred to as a "second hydraulic actuator". The hydraulic actuator corresponding to the third control valve is referred to as a "third hydraulic actuator".

The fluid tube for supplying the return fluid to the second control valve is referred to as a "first fluid tube", the return fluid being the operation fluid returning from the first hydraulic actuator to the first control valve.

In the embodiment, the bucket control valve 20B corresponds to the "first control valve". The auxiliary control valve 20C corresponds to the "second control valve". The boom control valve 20A corresponds to the "third control valve". In addition, the bucket cylinder 17 corresponds to the "first hydraulic actuator". The hydraulic actuator 16 of the auxiliary attachment corresponds to the "second hydraulic actuator". The boom cylinder 14 corresponds to the "third hydraulic actuator".

The first control valve, the second control valve, and the third control valve will be described below in detail.

The third control valve 20A is coupled to the output portion of the first hydraulic pump P1 by an output fluid tube 27. The output fluid tube 27 is branched at the intermediate portion.

The fluid tube branched from the output fluid tube 27 is connected to the input port 46*b* of the third control valve 20A. In addition, the output fluid tube 27 is connected to the third input port 46*c* of the third control valve 20A.

Thus, the operation fluid outputted from the first hydraulic pump P1 can be supplied to the third control valve 20A through the output fluid tube 27, the input port 46*b*, and the input port 46*c*.

The third control valve 20A and the first control valve 20B are coupled by a central fluid tube 51. The central fluid tube 51 couples the output port 41*c* of the third control valve 20A to the input port 42*c* and the input port 42*b* of the first control valve 20B.

When the third control valve 20A is set to the neutral position 20*a*3, the supply fluid, which is the operation fluid supplied from the output fluid tube 27 to the third control valve 20A, is supplied to the central fluid tube 51 through the third control valve 20A by the communication of the central fluid tube 53*c* coupling the input port 46*c* and the output port 41*c*.

The third control valve 20A and the first control valve 20B are coupled by the return fluid tube 61. The return fluid tube 61 is a fluid tube that supplies the return fluid to the first control valve 20B through the third control valve 20A, the return fluid returning from the third hydraulic actuator 14 to the third control valve 20A.

The return fluid tube 61 has a communication fluid tube 21*b*, a communication fluid tube 61*a*, and a central fluid tube 51. The communication fluid tube 21*b* is a fluid tube that couples the second port 32 of the third control valve 20A and the second port 14*e* of the third hydraulic actuator 14 to each other. The communication fluid tube 21*b* is a fluid tube through which the return fluid discharged from the second port 14*e* of the third hydraulic actuator 14 flows.

The communication fluid tube 61*a* is a fluid tube provided in the third control valve 20A and communicated with the communication fluid tube 21*b*. In particular, when the third control valve 20A is set to the first position 20*a*1, the communication fluid tube 61*a* couples the second port 32 of the third control valve 20A to the output port 41*c* of the third control valve 20A.

It should be noted that the return fluid tube 61 may include the communication fluid tube 61*b*. The communication fluid tube 61*b* is a fluid tube provided in the third control valve 20A and communicated with the communication fluid tube 21*a*. When the third control valve 20A is set to the second position 20*a*2, the communication fluid tube 61*b* is a fluid tube coupling the first port 31 of the third control valve 20A to the output port 41*c* of the third control valve 20A.

Thus, when the third control valve 20A is set to the second position 20*a*2, that is, when the boom cylinder serving as the third hydraulic actuator 14 is stretched and shortened, the return fluid discharged from the third hydraulic actuator 14 flows through the communication fluid tube 21*b*, the communication fluid tube 61*a* and the central fluid tube 51, and is supplied to the first control valve 20B.

Further, when the third control valve 20A is set to the second position 20*a*2 (when the boom cylinder is stretched and shortened), the return fluid discharged from the third hydraulic actuator 14 flows through the communication fluid tube 21*a*, the communication fluid tube 61*b* and the central fluid tube 51, and is supplied to the first control valve 20B.

The first control valve 20B and the second control valve 20C are coupled each other by a central fluid tube 72. The central fluid tube 72 couples the output port 43*c* of the first control valve 20B to the input port 44*c* and the input port 44*b* of the second control valve 20C.

Thus, when the first control valve 20B is set to the neutral position 20*b*3, the supply fluid which is the operation fluid supplied to the first control valve 20B passes through the central fluid tube 73*c* coupling the input port 42*c* to the output port 43*c*, and is supplied to the central fluid tube 72 connected to the output port 43*c*.

The first control valve 20B and the second control valve 20C are coupled by a first fluid tube 81. The first fluid tube 81 is a fluid tube that supplies the return fluid to the second control valve 20C through the first control valve 20B, the return fluid returning from the first hydraulic actuator 17 to the first control valve 20B.

The first fluid tube 81 has a communication fluid tube 22*a*, a first inner fluid tube 81*a*, and an outer fluid tube (central fluid tube) 72. The communication fluid tube 22*a* is a fluid tube coupling the first port 35 of the first control valve 20B to the second port 17*e* of the first hydraulic actuator 17 and is a fluid tube in which the return fluid discharged from the second port 17*e* flows.

The first inner fluid tube 81 a is a fluid tube provided in the first control valve 20B and communicated with the communication fluid tube 22*a*. More specifically, the first inner fluid tube 81*a* is a fluid tube that couples the first port 35 of the first control valve 20B to the output port 43*c* of the first control valve 20B when the first control valve 20B is set to the second position 20*b*2.

The outer fluid tube (central fluid tube) 72 is a fluid tube that is communicated with the first inner fluid tube 81*a* when the first control valve 20B is set to the second position 20*b*2, and is a fluid tube that supplies, to the second control valve 20C, the return fluid having passed through the first inner fluid tube 81*a*.

According to the above description, when the first control valve 20B is set to the second position 20*b*2 which is the lateral position, the supply fluid supplied to the first control valve 20B through the central fluid tube 51 flows through the communication fluid tube 22*b* and enters the first port 17*d* of the first hydraulic actuator 17. When the supply fluid is supplied to the first port 17*d*, the first hydraulic actuator 17 is stretched, for example.

When the first hydraulic actuator 17 is stretched, the return fluid discharged from the second port 17*e* of the first hydraulic actuator 17 passes through the communication fluid tube 22*a* and flows into the first inner fluid tube 81*a*, and the return fluid of the first inner fluid tube 81*a* flows toward the second control valve 20C through the central fluid tube 72. Thus, the return fluid from the first hydraulic actuator 17 can be supplied to the second control valve 20C.

The hydraulic system for the working machine includes a discharge fluid tube 24*b* capable of discharging the operation fluid to the hydraulic fluid tank 15 and the like. The discharge fluid tube 24*b* includes a fluid tube 24*b*1, a fluid tube 24*b*2, and a fluid tube 24*b*3. The fluid tube 24*b*1 is a fluid tube connected to the communication fluid tube 21*b*. A check valve 237 is provided in the middle of (on an intermediate portion of) the fluid tube 24*b*1.

The fluid tube 24*b*2 is a fluid tube connected to the communication fluid tube 21*a*. A relief valve 37 is provided in the middle of (on an intermediate portion of) the fluid tube 24*b*2. The fluid tube 24*b*3 is a fluid tube extending from the confluent portion between the fluid tube 24*b*1 and the fluid tube 24*b*2 to the operation fluid tank 15.

Further, the discharge fluid tube 24*b* includes a fluid tube 24*b*4, a fluid tube 24*b*5, and a fluid tube 24*b*6. The fluid tube 24*b*4 is a fluid tube connected to the communication fluid tube 22*b*. The fluid tube 24*b*5 is a fluid tube connected to the communication fluid tube 22*a*. A relief valve 38 is provided in the middle of (on intermediate portions of) the fluid tube 24*b*1 and the fluid tube 24*b*5.

The fluid tube 24*b*6 is a fluid tube connected to the supplying-discharging fluid tubes 83*a*. A relief valve 39 is provided in the middle of (on an intermediate portion of) the fluid tube 24*b*6. The fluid tube 24*b*4, the fluid tube 24*b*5, and the fluid tube 24*b*6 are each in communication with the fluid tube 24*b*3.

As shown in FIG. 1, the discharge fluid tube 24*b* includes a fluid tube 24*b*9. The fluid tube 24*b*9 is a fluid tube that is connected to the first control valve 20B and discharges, to the hydraulic oil tank 15 and the like, the operation fluid having passed through the first control valve 20B.

The fluid tube 24*b*9 is connected to the output port 34*a* of the first control valve 20B. When the first control valve 20B is set to the first position 20*b*1, the fluid tube 24*b*9 supplies the operation fluid that has passed through the first control valve 20B. The fluid tube 24*b*9 is communicated at least with the fluid tube 24*b*3.

The hydraulic system for the working machine includes a second fluid tube 550 and a third fluid tube 560. The second fluid tube 550 is a fluid tube that discharges, to the discharge fluid tube 24*b* through the first control valve 20B.

The second fluid tube 550 is provided in the first control valve 20B. When the first control valve 20B is set to the first position 20*b*1, the second fluid tube 550 couples the second port 36 to the output port 34*a*. That is, when the first control valve 20B is set to the first position 20*b*1, the second fluid tube 550 is communicated with the communication fluid tube 22*b* and the fluid tube 24*b*9.

When the first control valve 20B is set to the first position (second operational position) 20*b*1 which is the side position, the supply fluid supplied to the first control valve 20B through the central fluid tube 51 flows into the second port 17*e* of the first hydraulic actuator 17 through the communication fluid tube 22*a*. When the supply fluid is supplied to the second port 17*e*, the first hydraulic actuator 17 is shortened, for example.

When the first hydraulic actuator 17 is shortened, the return fluid discharged from the first port 17*d* of the first hydraulic actuator 17 flows to the second fluid tube 550 through the communication fluid tube 22*b*, and the return fluid from the second fluid tube 550 is discharged to the hydraulic oil tank 15 and the like through the fluid tube 24*b*9 and the fluid tube 24*b*3.

That is, in the case where the first control valve 20B is set to the first position (second operational position) 20*b*1, the first control valve 20B discharges the return fluid to the hydraulic oil tank 15 and the like without supplying, to the second control valve 20C, the return fluid from the first hydraulic actuator 17 different from a case where the first control valve 20B is set to the second position (first operational position) 20*b*1 at which the return fluid is supplied from the first control valve 20B to the second control valve 20C.

In other words, the first control valve 20B has the first position (second operational position) 20*b*1 and the second position (first operational position) 20*b*2. The first position (second operational position) 20*b*1 does not allow the return fluid from the first hydraulic actuator 17 to be supplied to the second control valve 20C arranged on the downstream side. The second position (first operational position) 20*bs* allows the return fluid from the first hydraulic actuator 17 to be supplied to the second control valve 20C arranged on the downstream side.

The third fluid tube 560 is a fluid tube that supplies the supply fluid, which is the operation fluid supplied to the first control valve 20B, to the second control valve 20C, separately from the return fluid supplied to the first control valve 20B. In other words, in addition to the return fluid supplied to the first control valve 20B, the third fluid tube 560 is a fluid tube that supplies the supply fluid, which is the operation fluid supplied to the first control valve 20B, to the central fluid tube 72 of the first fluid tube 81, separately from the return fluid supplied to the first control valve 20B.

The third fluid tube 560 is provided in the first control valve 20B. When the first control valve 20B is set to the first position 20*b*1, the third fluid tube 560 couples the input port 42*c* to the output port 43*c*. That is, when the first control valve 20B is set to the first position 20*b*1, the third fluid tube 560 is communicated with the central fluid tube 51 and the central fluid tube 72. The third fluid tube 560 is provided with a throttle portion (throttle) 561 configured to decrease a flow rate of the operation fluid.

For example, it is assumed that the first control valve 20B is set to the first position 20*a*1, that is, the bucket 11 is performing the shoveling operation. In that case, the return fluid returning from the first hydraulic actuator 17, which is the bucket cylinder, to the first control valve 20B is not supplied to the second control valve 20C.

In addition, when the bucket 11 is performing the shoveling operation, the central fluid tube 51 is communicated with the central fluid tube 72 by the third fluid tube 560, and the supply fluid supplied from the third control valve 20A side (the first hydraulic pump P1 side) to the first control valve 20B is supplied to the second control valve 20C instead of the return fluid.

That is, the first control valve 20B discharges the return fluid to the discharge fluid tube 24*b* without returning the return fluid to the second control valve 20C, the return fluid returning to the first control valve 20B, while the first control valve 20B is capable of supplying the supply fluid other than the return fluid to the second control valve 20C.

In other words, in the series circuit that supplies, to the second control valve 20B, the return fluid that has passed through the first control valve 20B, the supply fluid can be supplied from the first control valve 20B to the second control valve 20C in the shoveling operation of the bucket 11 instead of the return fluid, for example.

As the result, it is possible to prevent the motion of the first hydraulic actuator 17 from slowing down when the shoveling operation or the like of the bucket 11 is being performed, the slowing down being caused because the flowing of the return fluid stops due to some circumstances, and the second hydraulic actuator also can be operated smoothly by the supply fluid supplied to the second control valve 20C instead of the return fluid.

Figure 2:
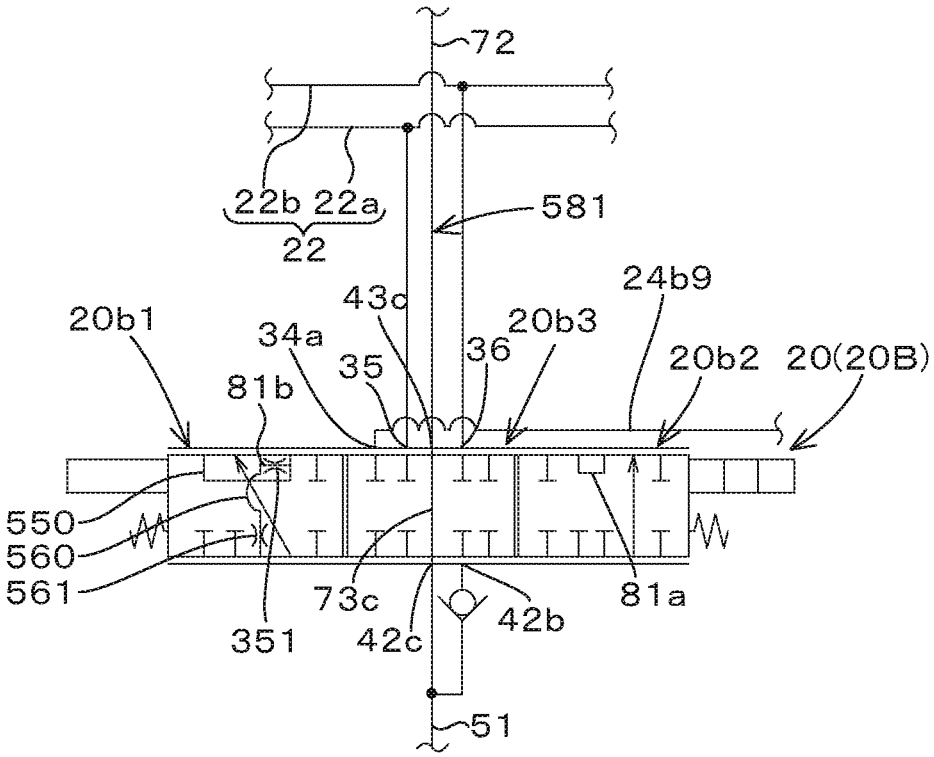
FIG. 2 is an enlarged view illustrating a first control valve of a first modified example of the hydraulic system for the working machine according to the embodiment.

FIG. 2 shows a modified example of the hydraulic system for the working machine. The hydraulic system for the working machine of a first modified example is a modified example of the first fluid tube, and the fluid tube 581 serves as the first fluid tube. The first fluid tube (fluid tube) 581 is a fluid tube that supplies, to the second control valve 20C, the return fluid returning from the first hydraulic actuator 17 to the first control valve 20B through the first control valve 20B.

The first fluid tube (fluid tube) 581 includes a communication fluid tube 22*b*, a second inner fluid tube 81*b*, and an outer fluid tube (central fluid tube) 72. The second inner fluid tube 81*b* is a fluid tube provided in the first control valve 20B and communicated with the communication fluid tube 22*b*. The second inner fluid tube 81*b* is a fluid tube that couples the second port 36 of the first control valve 20B to the third fluid tube 560 when the first control valve 20B is set to the first position 20*b*1.

In other words, the second inner fluid tube 81*b* is a fluid tube that couples the second fluid tube 550 and the third fluid tube 560. The second inner fluid tube 81*b* is provided with a throttle portion 351 configured to decrease the flow rate of hydraulic fluid.

According to that, for example, in a case where the first hydraulic actuator 17 is shortened or in a case where the bucket performs the shoveling operation, the return fluid returned from the first hydraulic actuator 17 to the first control valve 20B can be added to the supply fluid flowing through the second fluid tube 550 (the operation fluid supplied from the first hydraulic pump P1 side to the first control valve 20B).

That is, in the first modified example, a part of the return fluid returned from the first hydraulic actuator 17 to the first control valve 20B can be supplied to the second control valve 20C by the fluid tube 581.

Figure 3:
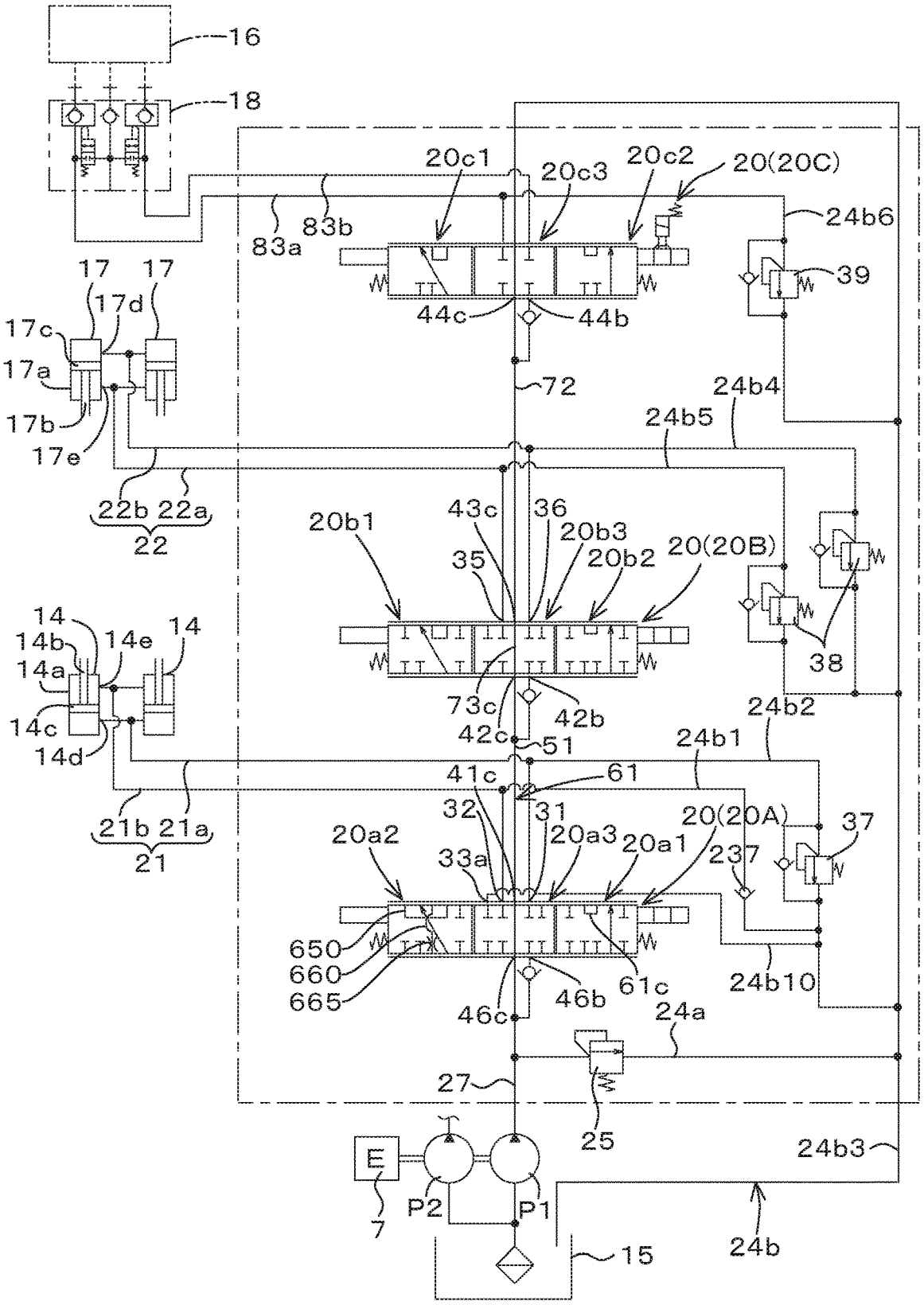
FIG. 3 is a view illustrating a second modified example of the hydraulic system for the working machine according to the embodiment.

FIG. 3 shows a modified example of the hydraulic system for the working machine. In the hydraulic system for the working machine of a second modification, the boom control valve 20A serves as the "first control valve", the bucket control valve 20B serves as the "second control valve", and the auxiliary control valve 20C serves as the "third control valve".

The boom cylinder 14 serves as the "first hydraulic actuator", the bucket cylinder 17 serves as the "second hydraulic actuator", and the hydraulic actuator 16 of the auxiliary attachment serves as the "third hydraulic actuator".

In the hydraulic system for the working machine of the second modified example, the discharge fluid tube 24*b* includes a fluid tube 24*b*10. The fluid tube 24*b*10 is a fluid tube that is connected to the first control valve 20A and discharges, to the hydraulic oil tank 15 and the like, the operation fluid that has flown through the first control valve 20A.

The fluid tube 24*b*10 is connected to the output port 33*a* of the first control valve 20A. When the first control valve 20A is set to the second position 20*a*2, the fluid tube 24*b*10 allows the operation fluid to flow, the operation fluid having flown through the first control valve 20A. The fluid tube 24*b*10 is communicated at least with the fluid tube 24*b*3.

In the hydraulic system for the working machine of the second modified example, the return fluid tube 61 serves as the first fluid tube, the fluid tube 650 serves as the second fluid tube, and the fluid tube 660 serves as the third fluid tube.

The return fluid tube (first fluid tube) 61 includes the communication fluid tube 21*b*, the inner fluid tube 61*c*, and the outer fluid tube (central fluid tube) 51. The inner fluid tube 61*c* is a fluid tube provided in the first control valve 20A and communicated with the communication fluid tube 21*b*.

More specifically, the inner fluid tube 61*c* is a fluid tube that couples the second port 32 of the first control valve 20A to the output port 41*c* of the first control valve 20A when the first control valve 20A is set to the first position 20*a*1.

Thus, when the first control valve 20A is set to the first position 20*a*1, the return fluid discharged from the first hydraulic actuator 14 flows through the communication fluid tube 21*b*, the inner fluid tube 61*c* and the central fluid tube 51, and is supplied to the second control valve 20A.

The fluid tube (second fluid tube) 650 is a fluid tube that discharges, to the discharge fluid tube 24*b*, the return fluid that has passed through the first control valve 20A. The fluid tube 650 is provided in the first control valve 20A, and the fluid tube 650 couples the first port 31 to the output port 33*a* when the first control valve 20A is at the second position 20*a*2.

That is, when the first control valve 20A is set to the second position 20*a*2, the fluid tube 650 couples the communication fluid tube 21*a* to the fluid tube 24*b*10.

Thus, when the first control valve 20A is set to the second position 20*a*2 which is the lateral position, the supply fluid supplied to the first control valve 20A through the central fluid tube 27 enters the second port 14*e* of the first hydraulic actuator 14 through the communication fluid tube 22*b*. When the supply fluid is supplied to the second port 14*e*, the first hydraulic actuator 14 is shortened, for example.

When the first hydraulic actuator 14 is shortened, the return fluid discharged from the first port 14*d* of the first hydraulic actuator 14 flows into the fluid tube 650 through the communication fluid tube 21*a*, and the return fluid from the fluid tube 650 is discharged to the operation fluid tank 15 and the like through the fluid tube 24*b*10 and the fluid tube 24*b*3.

Thus, in the first control valve 20A, when the first control valve 20A is set to the second position 20*a*2, the return fluid from the first hydraulic actuator 14 is discharged to the hydraulic oil tank 15 or the like without supplying the return fluid to the second control valve 20B, unlike the case of being set to the first position 20*a*1.

That is, when the first control valve 20A is set to the first position (first operation position) 20*a*1, the first control valve 20A supplies, to the second control valve 20B arranged on the downstream side, the return fluid supplied to the first control valve 20A. And, when the first control valve 20A is set to the second position (second operational position) 20*a*2, the first control valve 20A does not supply the return fluid to the second control valve 20B arranged on the downstream side.

The third fluid tube 660 is a fluid tube that supplies the supply fluid, which is the operation fluid supplied to the first control valve 20A, to the second control valve 20B, separately from the return fluid supplied to the first control valve 20A. The fluid tube 660 is provided in the first control valve 20A and couples the input port 46*c* to the output port 41*c* when the first control valve 20A is set to the second position 20*a*2.

That is, when the first control valve 20A is set to the second position 20*a*2, the fluid tube 660 couples the discharge fluid tube 27 to the central fluid tube 51. The fluid tube 660 is provided with a throttle portion 665 configured to reduce the flow rate of the operation fluid.

According to the above configuration, when the boom 10 is moved downward, for example, the return fluid is not supplied to the second control valve 20B, the return fluid having returned from the first hydraulic actuator 14 serving as the boom cylinder to the first control valve 20A.

On the other hand, when the boom 10 is moved downward, the fluid tube 660 couples the discharge fluid tube 27 to the central fluid tube 51, and the supply fluid supplied from the first hydraulic pump P1 side to the first control valve 20A can be supplied to the second control valve 20B instead of the return fluid.

That is, in the first control valve 20A, the return fluid returning to the first control valve 20A is discharged to the discharge fluid tube 24*b* without being returned to the second control valve 20B, while the supply fluid other than the return fluid can be supplied to the second control valve 20B.

In other words, in the series circuit configured to supply, to the second control valve 20B, the return fluid that has passed through the first control valve 20A, the supply fluid can be supplied from the first control valve 20A to the second control valve 20B instead of the return fluid when the boom 10 is moved downward, for example.

As the result, it is possible to prevent the motion of the first hydraulic actuator 14 from slowing down when the boom 10 is moved downward, the slowing down being caused because the flowing of the return fluid stops due to some circumstances, and the second hydraulic actuator also can be operated smoothly by the supply fluid supplied to the second control valve 20B instead of the return fluid.

Figure 4A:
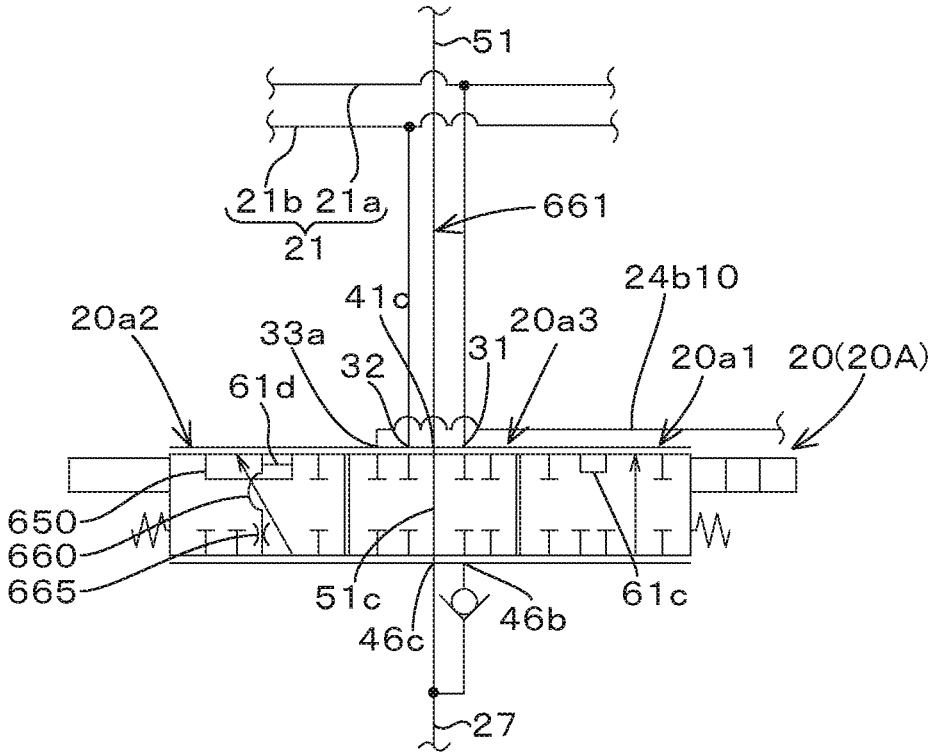
FIG. 4A is an enlarged view illustrating a first control valve of a third modified example of the hydraulic system for the working machine according to the embodiment.

FIG. 4A shows a modified example of the hydraulic system for the working machine. The hydraulic system for the working machine of a third modified example is a modified example of the first fluid tube, and the fluid tube 661 serves as the first fluid tube. The first fluid tube (fluid tube) 661 is a fluid tube that supplies, to the second control valve 20B, the return fluid returning from the first hydraulic actuator 14 to the first control valve 20A through the first control valve 20A.

The first fluid tube (fluid tube) 661 includes a communication fluid tube 21*a*, an inner fluid tube 61*b*, and an outer fluid tube (central fluid tube) 51. The inner fluid tube 61*b* is a fluid tube provided in the first control valve 20A and communicated with the communication fluid tube 21*a*. The inner fluid tube 61*b* is a fluid tube that couples the first port 31 of the first control valve 20A to the fluid tube 660 when the first control valve 20A is set to the second position 20*a*2.

Figure 4B:
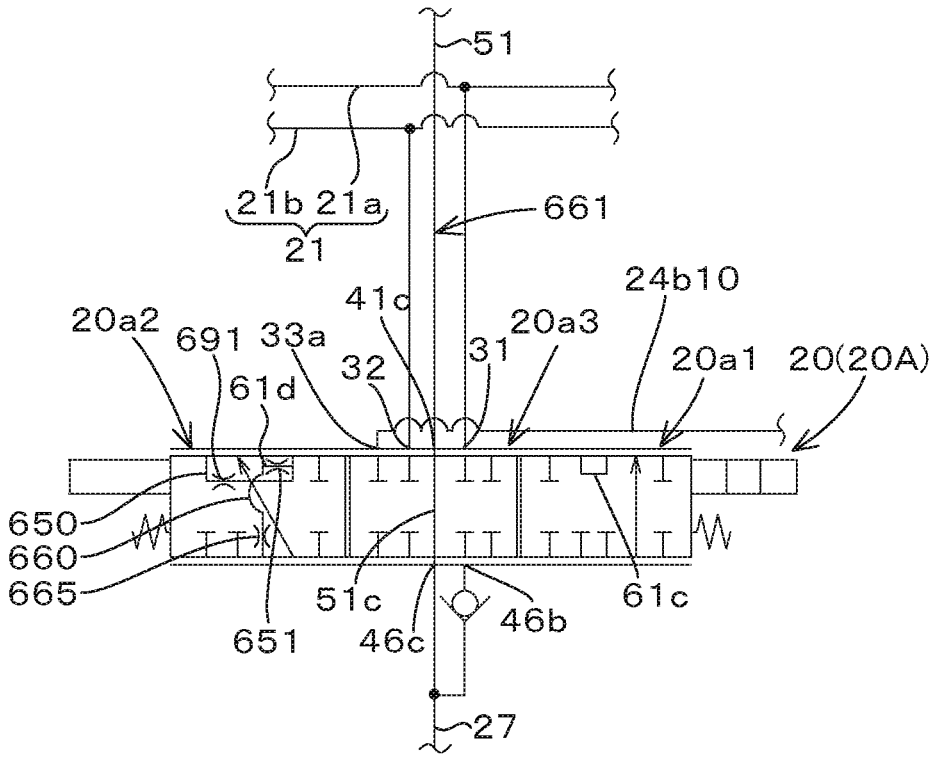
FIG. 4B is a view illustrating a modified example of the first control valve according to the embodiment.

In other words, the inner fluid tube 61*d* is a fluid tube coupling the fluid tube 650 to the fluid tube 660. As shown in FIG. 4B, the inner fluid tube 61*d* may be provided with a throttle portion 651 configured to reduce the flow rate of operation fluid. However, as shown in FIG. 4A, the inner fluid tube 61*d* may be provided with no throttle portion.

In addition, as shown in FIG. 4B, it is preferred that the fluid tube 650 is provided with the throttle portion 691 when the inner fluid tube 61*d* is provided with the throttle portion 651.

According to that configuration, when the boom 10 is moved downward, for example, the return fluid returned from the first hydraulic actuator 14 to the first control valve 20A can be added to the supply fluid passing through the fluid tube 660 (the operation fluid supplied from the first hydraulic pump P1 side to the first control valve 20A).

That is, in the modified example, the fluid tube 661 is configured to supply, to the second control valve 20B, a part of the return fluid returned from the first hydraulic actuator 14 to the first control valve 20A.

In the above description, the embodiment of the present invention has been explained. However, all the features of the embodiment disclosed in this application should be considered just as examples, and the embodiment does not restrict the present invention accordingly. A scope of the present invention is shown not in the above-described embodiment but in claims, and is intended to include all modifications within and equivalent to a scope of the claims.

The first control valve and the second control valve are not limited to the above-described embodiments, and any control valve provided in the working machine may be adopted.

In the above-described embodiments, the operation fluid is discharged to the operation fluid tank. However, the operation fluid may be discharged to other places. That is, the fluid tube for discharging the hydraulic fluid may be connected to a portion other than the operation fluid tank. For example, the fluid tube may be connected to the suction portion of the hydraulic pump (the portion for sucking the operation fluid) or to another portion.

In the above-described embodiments, the control valve is constituted of a three-position selector valve. However, the number of switching positions is not limited, and the control valve may be constituted of a two-position selector valve, a four-position selector valve, or another selector valve. In the above-described embodiment, the hydraulic pump is constituted of a constant displacement pump. However, the hydraulic pump may be constituted of a variable displacement pump whose discharge amount is changed by movement of the swash plate, or may be constituted of another hydraulic pump, for example.

In addition, the first hydraulic actuator, the second hydraulic actuator, the third hydraulic actuator, the first control valve, the second control valve, and the third control valve are not limited to the configurations of the above-described embodiment, and may be those provided in the working machine 1.

In the above-described embodiments, the inner fluid tube 61*d* and the fluid tube 660 are provided inside the control valve. However, the inner fluid tube 61*d* and the fluid tube 660 may be provided outside the control valve.

What is claimed is:

1. A hydraulic system for a working machine, comprising:
a hydraulic pump to output an operation fluid;
a first hydraulic actuator;
a second hydraulic actuator;
a first control valve to control the first hydraulic actuator;
a second control valve to control the second hydraulic actuator, the second control valve being arranged on a downstream side of the first control valve;
a discharge fluid tube in which the operation fluid having passed through the first control valve flows, the discharge fluid tube being connected to the first control valve;
a first fluid tube in which a return fluid that is the operation fluid returning from the first hydraulic actuator to the first control valve flows toward the second control valve, the first fluid tube coupling the first control valve to the second control valve;
a second fluid tube in which the return fluid flows toward the discharge fluid tube; and
a third fluid tube in which a supply fluid that is the operation fluid other than the return fluid flows toward the first fluid tube, the supply fluid having been supplied from the hydraulic pump to the first control valve,
wherein the first fluid tube includes:
a communication fluid tube in which the return fluid flows, the communication fluid tube coupling the first control valve to the first hydraulic actuator;
a first inner fluid tube arranged in the first control valve and communicated with the communication fluid tube; and
an outer fluid tube communicated with the first inner fluid tube, the outer fluid tube coupling the first control valve to the second control valve,
wherein the second fluid tube is arranged in the first control valve and communicated with the discharge fluid tube,
and wherein the third fluid tube is arranged in the first control valve and communicated with the outer fluid tube.

2. The hydraulic system according to claim 1, further comprising a second inner fluid tube to couple the second fluid tube second fluid tube to the third fluid tube.

3. The hydraulic system according to claim 2, comprising:
a bucket; and
a working tool other than the bucket, the working tool being arranged on a boom,
wherein the first hydraulic actuator is a bucket cylinder configured to move the bucket,
and wherein the second hydraulic actuator is a hydraulic device configured to move the working tool.

4. The hydraulic system according to claim 2, comprising:
a bucket; and
a working tool other than the bucket, the working tool being arranged on a boom,
wherein the first hydraulic actuator is a bucket cylinder configured to move the bucket,
wherein the second hydraulic actuator is a hydraulic device configured to move the working tool,
and wherein the first control valve has a shoveling position and a dumping position and configured to be switched between the shoveling position and the dumping position,
the shoveling position allowing the bucket cylinder to be operated to move the bucket in a shoveling motion,
the dumping position allowing the bucket cylinder to be operated to move the bucket in a dumping motion, and
the first control valve discharges the return fluid to the discharge fluid tube at the shoveling position.

5. The hydraulic system according to claim 2, comprising:
a boom; and
a bucket arranged on the boom,
wherein the first hydraulic actuator is a boom cylinder configured to move the boom,
and wherein the second hydraulic actuator is a bucket cylinder configured to move the bucket.

6. The hydraulic system according to claim 2, comprising:
a boom; and
a bucket arranged on the boom,
wherein the first hydraulic actuator is a boom cylinder configured to move the boom,
wherein the second hydraulic actuator is a bucket cylinder configured to move the bucket,
and wherein the first control valve has a moving-up position and a moving-down position and configured to be switched between the moving-up position and the moving-down position,
the moving-up position allowing the boom cylinder to be operated to move the boom upward,
the moving-down position allowing the boom cylinder to be operated to move the boom downward, and
the first control valve discharges the return fluid to the discharge fluid tube at the moving-down position.

7. The hydraulic system according to claim 1, comprising:
a bucket; and
a working tool other than the bucket, the working tool being arranged on a boom, wherein the first hydraulic actuator is a bucket cylinder configured to move the bucket, and wherein the second hydraulic actuator is a hydraulic device configured to move the working tool.

8. The hydraulic system according to claim 1, comprising:
a bucket; and
a working tool other than the bucket, the working tool being arranged on a boom,
wherein the first hydraulic actuator is a bucket cylinder configured to move the bucket,
wherein the second hydraulic actuator is a hydraulic device configured to move the working tool,
and wherein the first control valve has a shoveling position and a dumping position and configured to be switched between the shoveling position and the dumping position,
the shoveling position allowing the bucket cylinder to be operated to move the bucket in a shoveling motion,
the dumping position allowing the bucket cylinder to be operated to move the bucket in a dumping motion, and
the first control valve discharges the return fluid to the discharge fluid tube at the shoveling position.

9. The hydraulic system according to claim 1, comprising:
a boom; and
a bucket arranged on the boom,
wherein the first hydraulic actuator is a boom cylinder configured to move the boom,
and wherein the second hydraulic actuator is a bucket cylinder configured to move the bucket.

10. The hydraulic system according to claim 1, comprising:
a bucket arranged on the boom, wherein the first hydraulic actuator is a boom cylinder configured to move the boom, wherein the second hydraulic actuator is a bucket cylinder configured to move the bucket, and wherein the first control valve has a moving-up position and a moving-down position and configured to be switched between the moving-up position and the moving-down position, the moving-up position allowing the boom cylinder to be operated to move the boom upward, the moving-down position allowing the boom cylinder to be operated to move the boom downward, and the first control valve discharges the return fluid to the discharge fluid tube at the moving-down position.

11. A hydraulic system for a working machine, comprising:

a hydraulic pump to output an operation fluid;

a first hydraulic actuator;

a second hydraulic actuator;

a first control valve to control the first hydraulic actuator; and a second control valve to control the second hydraulic actuator, the second control valve being arranged on a downstream side of the first control valve, wherein the first control valve has a first operational position and a second operational position and is switched between the first operational position and the second operational position, the first control valve including a first inner fluid tube, a second fluid tube and a third fluid tube arranged therein, the first operational position allowing a return fluid to be supplied to the second control valve through the first inner fluid tube, the return fluid returning from the first hydraulic actuator to the first control valve, and the second operational position allowing the return fluid to be discharged to a discharge fluid tube through the second fluid tube in the first control valve, and allowing a supply fluid to be supplied to the second control valve through the third fluid tube, the supply fluid being supplied from the hydraulic pump to the first control valve separately from the return fluid.

12. The hydraulic system according to claim 11, comprising:

a bucket; and a working tool other than the bucket, the working tool being arranged on a boom, wherein the first hydraulic actuator is a bucket cylinder configured to move the bucket, wherein the second hydraulic actuator is a hydraulic device configured to move the working tool, wherein the first operational position is a dumping position allowing the bucket cylinder to be operated to move the bucket in a dumping motion, and wherein the second operational position is a dumping position allowing the bucket cylinder to be operated to move the bucket in a dumping motion.

13. The hydraulic system according to claim 11, comprising:

a boom; and a bucket arranged on the boom, wherein the first hydraulic actuator is a boom cylinder configured to move the boom, wherein the second hydraulic actuator is a bucket cylinder configured to move the bucket, wherein the first operational position is a moving-up position allowing the boom cylinder to be operated to move the boom upward, and wherein the second operational position is a moving-down position allowing the boom cylinder to be operated to move the boom downward.

14. The hydraulic system according to claim 11, wherein the first control valve include a second inner fluid tube arranged therein to couple the second fluid tube to the third fluid tube.

15. A hydraulic system for a working machine, comprising:

a hydraulic pump to output an operation fluid;

a first hydraulic actuator;

a second hydraulic actuator;

a first control valve to control the first hydraulic actuator, having a first operational position and a second operational position being switched from a neutral position;

a second control valve arranged downstream the first control valve to control the second hydraulic actuator;

a first fluid tube having a first inner fluid tube arranged in the first control valve to connect the first hydraulic actuator through the first control valve to the second control valve at the first operational position;

a second fluid tube arranged in the first control valve to connect the first control valve to a discharge fluid tube at the second operational position, thereby to discharge the operation fluid from the first control valve to an operation fluid tank, the discharge fluid tube continuously extending from the first control valve to the operation fluid tank and being open along its entire length at all times; and a third fluid tube arranged in the first control valve to connect the pump to the second control valve at the second operational position.

16. The hydraulic system according to claim 15, wherein the third fluid tube has a first throttle arranged in the first control valve.

17. The hydraulic system according to claim 15, wherein the first control valve includes a second inner fluid tube arranged therein to connect the second fluid tube to the third fluid tube.

18. The hydraulic system according to claim 17, wherein the second inner fluid tube has a second throttle.

* * * * *